US009951621B2

(12) United States Patent
Gurao et al.

(10) Patent No.: US 9,951,621 B2
(45) Date of Patent: Apr. 24, 2018

(54) ROTOR DISC WITH FLUID REMOVAL CHANNELS TO ENHANCE LIFE OF SPINDLE BOLT

(71) Applicant: Siemens Aktiengesellschaft, München (DE)

(72) Inventors: Manish S. Gurao, Oviedo, FL (US); Kevin M. Light, Maitland, FL (US); Zafir A. M. Abdo, Orlando, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 376 days.

(21) Appl. No.: 14/267,134

(22) Filed: May 1, 2014

(65) Prior Publication Data

US 2014/0363307 A1 Dec. 11, 2014

Related U.S. Application Data

(60) Provisional application No. 61/831,470, filed on Jun. 5, 2013.

(51) Int. Cl.

| | |
|---|---|
| ***F01D 5/02*** | (2006.01) |
| ***F01D 5/06*** | (2006.01) |
| ***F01D 25/32*** | (2006.01) |

(52) U.S. Cl.

CPC ..... *F01D 5/02* (2013.01); *F01D 5/066* (2013.01); *F01D 25/32* (2013.01); (Continued)

(58) Field of Classification Search

CPC . F01D 25/32; F01D 5/02; F01D 5/066; F05D 2240/90; F05D 2250/71; (Continued)

(56) References Cited

U.S. PATENT DOCUMENTS 2,656,147 A * 10/1953 Brownhill ..... F01D 5/084 416/193 A
4,008,000 A 2/1977 Gradl et al.
(Continued)

FOREIGN PATENT DOCUMENTS

CN 1031877 A 3/1989
EP 0909878 A2 4/1999
(Continued)

*Primary Examiner* — William McCalister

(57) ABSTRACT

A rotor disc configured to reduce the likelihood of fractures developing in spindle bolts in gas turbine engines is disclosed. The spindle bolts extend axially through the rotor disc to retain the rotor assembly in place in the gas turbine engine. The rotor disc may be formed from a rotor disc body having a plurality of circumferentially positioned spindle bolt holes sized to house a spindle bolts within each spindle bolt hole. One or more relief channels, which also may be referred to as scallops, may extend radially outward from one of the spindle bolt holes. The relief channels may foster removal of condensation and debris from the space between the spindle bolt and the surface forming the spindle bolt hole and may be configured to discourage the ingress of air through the relief channel and into space between the spindle bolt and the surface forming the spindle bolt hole.

20 Claims, 6 Drawing Sheets

(52) U.S. Cl.
CPC ..... *F05D 2240/90* (2013.01); *F05D 2250/71* (2013.01); *F05D 2260/31* (2013.01); *F05D 2260/607* (2013.01); *F05D 2260/608* (2013.01); *F05D 2260/94* (2013.01)

(58) Field of Classification Search
CPC ..... F05D 2260/31; F05D 2260/607; F05D 2260/608; F05D 2260/94; F16D 65/128; F16D 2065/1328
USPC ..... 415/110, 111, 229, 230, 170.1, 104–107, 415/115; 416/95, 96 R, 244 A
See application file for complete search history.

(56) References Cited

U.S. PATENT DOCUMENTS 4,021,138 A * 5/1977 Scalzo ..... F01D 5/081 416/193 A
4,035,102 A * 7/1977 Maghon ..... F01D 5/084 416/95
4,425,079 A * 1/1984 Speak ..... F01D 5/081 415/115
4,484,858 A * 11/1984 Kurosawa ..... F01D 5/18 416/193 A
5,226,785 A * 7/1993 Narayana ..... F01D 5/02 415/115
5,284,230 A * 2/1994 Takaki ..... F16D 65/128 188/218 XL
5,325,941 A * 7/1994 Farinacci ..... C22C 32/0089 188/218 XL
5,340,274 A * 8/1994 Cunha ..... F01D 5/182 415/114
5,542,503 A * 8/1996 Dunn ..... F16D 65/128 188/18 A
5,586,860 A * 12/1996 Bertrand ..... F01D 5/082 415/115
5,695,319 A * 12/1997 Matsumoto ..... F01D 5/085 415/114
5,700,130 A * 12/1997 Barbot ..... F01D 5/081 415/115
5,864,935 A * 2/1999 Baumgartner ..... F16D 65/123 188/18 A
5,984,636 A * 11/1999 Fahndrich ..... F01D 5/3015 415/178
6,065,282 A * 5/2000 Fukue ..... F02C 7/185 415/115
6,094,905 A * 8/2000 Fukuyama ..... F01D 5/06 415/115
6,152,270 A * 11/2000 Giorgetti ..... F16D 65/12 188/18 A
6,161,660 A * 12/2000 Suga ..... F16D 65/0006 188/218 XL
7,165,889 B2 * 1/2007 Light ..... F16C 32/0659 384/115
7,766,607 B2 * 8/2010 Charier ..... F01D 5/082 415/115
8,387,401 B2 * 3/2013 Hashimoto ..... F01D 5/081 415/115
8,465,259 B2 * 6/2013 Light ..... F04D 29/054 416/198 A
2005/0264124 A1 * 12/2005 Zhang ..... H02K 15/0006 310/214
2012/0204574 A1 * 8/2012 Zhang ..... F01D 9/041 60/796

FOREIGN PATENT DOCUMENTS

EP 1217231 A1 6/2002
EP 2484866 A2 8/2012
EP 2538021 A2 12/2012
JP S597087 A 1/1984

* cited by examiner

ROTOR DISC WITH FLUID REMOVAL CHANNELS TO ENHANCE LIFE OF SPINDLE BOLT

CROSS-REFERENCE TO RELATED APPLICATION

This application claims the benefit of U.S. Provisional Patent Application No. 61/831,470, filed Jun. 5, 2013, the entirety of which is incorporated herein.

FIELD OF THE INVENTION

The invention relates to spindle bolts in gas turbine engines and more particularly, to systems for reducing the likelihood of spindle bolts fracturing during use in gas turbine engines.

BACKGROUND OF THE INVENTION

Turbine engines are susceptible to spindle bolt fracture. Spindle bolt failure often occurs in similar locations within different engines. Extensive analysis has shown that the failure is due to fretting fatigue together with water and debris build up behind the bolt fracture. The fretting crack that are typically initiated under fretting fatigue grow in the presence of debris. The fretting crack propagates under high cycle fatigue (HCF) loading and eventually the spindle bolt fractures under tension due to axial bolt pre load.

SUMMARY OF THE INVENTION

A rotor disc configured to reduce the likelihood of fractures developing in spindle bolts in gas turbine engines is disclosed. The spindle bolts extend axially through the rotor disc to retain the rotor assembly in place in the gas turbine engine. The rotor disc may be formed from a rotor disc body having a plurality of circumferentially positioned spindle bolt holes sized to house a spindle bolts within each spindle bolt hole. One or more relief channels, which also may be referred to as scallops, may extend radially outward from one of the spindle bolt holes. The relief channels may foster removal of condensation and debris from the space between the spindle bolt and the surface forming the spindle bolt hole and may be configured to discourage the ingress of air through the relief channel and into space between the spindle bolt and the surface forming the spindle bolt hole.

In at least one embodiment, the rotor disc may be formed from a rotor disc body having a plurality of circumferentially positioned spindle bolt holes sized to house a spindle bolt within each spindle bolt hole. At least one relief channel may extend radially outward from one of the spindle bolt holes, wherein the relief channel may have a decreasing cross-sectional area moving radially outward. The relief channel may have a reduction in cross-sectional area of one half of its width across a length of the at least one relief channel. In at least one embodiment, the relief channel may have an inner radius of 10 millimeters and an outer radius of 5 millimeters. The relief channel may be offset circumferentially from the spindle bolt hole. In particular, in at least one embodiment, the relief channel may be offset circumferentially between about five degrees and about ten degrees from the spindle bolt hole. In yet another embodiment, the relief channel may be offset circumferentially about 7.5 degrees from the spindle bolt hole. In at least one embodiment, there may be a plurality of relief channels spaced equidistant from each other around the rotor disc body.

In at least one embodiment, a longitudinal axis of the relief channel may be nonlinear and nonorthogonal to a radially extending axis extending from a centerpoint of the rotor disc. An inner opening of the relief channel may be advanced in a direction of rotation of the rotor disc from an outer opening. The longitudinal axis of the relief channel may be positioned between 55 degrees and 85 degrees relative to the radially extending axis extending from the centerpoint of the rotor disc. In at least one embodiment, the longitudinal axis of the relief channel may be positioned at 70 degrees to the radially extending axis extending from the centerpoint of the rotor disc. The rotor may also include a circumferential groove that places at least one of the spindle bolt holes in fluid communication with the at least one relief channel. The relief channel may also include a nozzle in fluid communication an outer end of the relief channel, wherein a radially outer end of the nozzle has a smaller cross-sectional area than the outer end of the relief channel. The relief channel may have a curved longitudinal axis. The rotor may also include a boss coupled to a seal disc face adjacent to the spindle bolt holes to prevent the ingress of condensation into the spindle bolt holes.

During use in turbine engine operation, condensation forms in the space between the spindle bolt and the surface forming the spindle bolt hole. Debris also collects in this space between the spindle bolt and the surface forming the spindle bolt hole as well. As the rotor discs spins, centrifugal forces cause the condensation to be forced outwardly into the circumferential groove, where the condensation and debris flow into the relief channels and are exhausted out of the rotor disc body through the outer opening.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
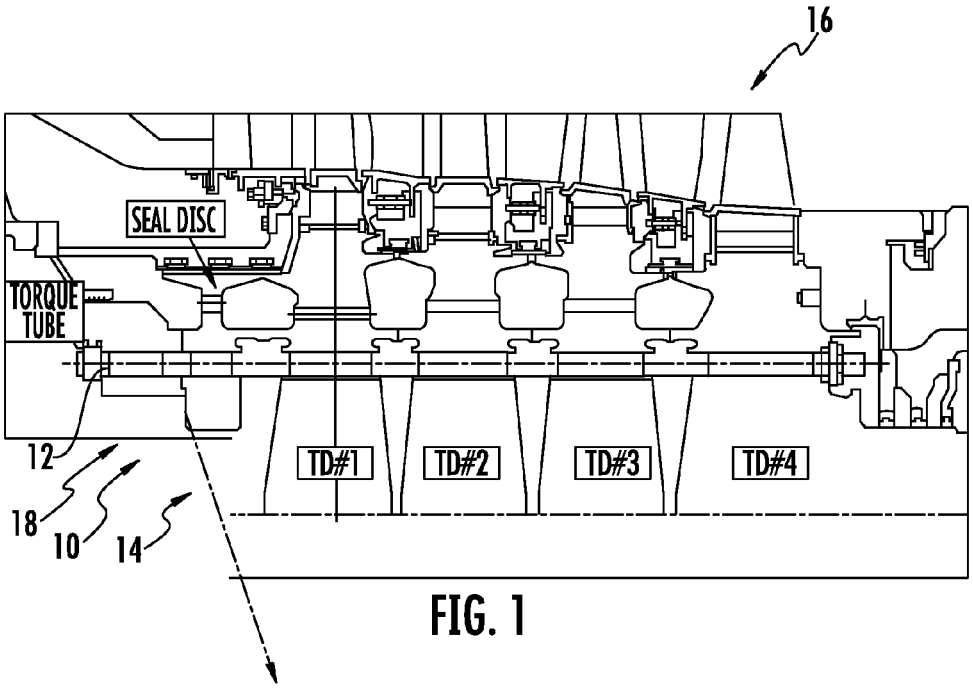
FIG. 1 is partial cross-sectional view of a gas turbine engine and a rotor assembly with spindle bolt extending therethrough.
Figure 2:
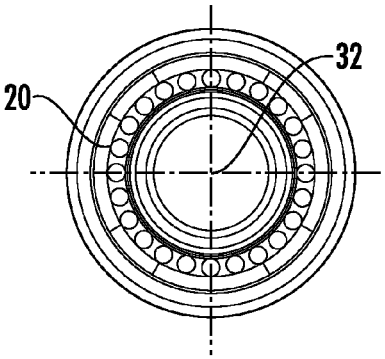
FIG. 2 is an end view of the rotor disc of the rotor assembly with the spindle bolts removed and a relief channel, which may also be referred to as a scallop.

As shown in FIGS. 1-14, a rotor disc 10 configured to reduce the likelihood of fractures developing in spindle bolts 12 in gas turbine engines 16 is disclosed. The spindle bolts 12 extend axially through the rotor disc 10 to retain the rotor assembly 14 in place in the gas turbine engine 16. The rotor disc 10 may be formed from a rotor disc body 18 having a plurality of circumferentially positioned spindle bolt holes 20 sized to house a spindle bolts 12 within each spindle bolt hole 20. One or more relief channels 22, which also may be referred to as scallops, may extend radially outward from one of the spindle bolt holes 20. The relief channels 22 may foster removal of condensation and debris from the space between the spindle bolt 12 and the surface forming the spindle bolt hole 20 and may be configured to discourage the ingress of air through the relief channel 22 and into the space between the spindle bolt 12 and the surface forming the spindle bolt hole 20.

The relief channel 22 may have a decreasing cross-sectional area moving radially outward from in the rotor disc body 18. Such a configuration causes air entering into the relief channel 22 through an outer opening 24 of the relief channel 22 to reduce in velocity as the air moves toward the inner opening 26. In one embodiment, the relief channel 22 may have a reduction in cross-sectional area of one half of its width across a length of the relief channel 22. The relief channel 22 may have an inner radius of 10 millimeters and an outer radius of 5 millimeters.

As shown in FIGS. 6-8, 10 and 11, the relief channel 22 may be offset circumferentially from the spindle bolt hole. The relief channel 22 may be offset circumferentially between about five degrees and about ten degrees from the spindle bolt hole 20. The relief channel 22 may be offset circumferentially about 7.5 degrees from the spindle bolt hole 20. The offset relief channel 22 may eliminate blow back of debris and water particle on the surface of the spindle bolt 12 which happens if the relief channel 22 is in line with a spindle bolt hole 20.

Figure 12:
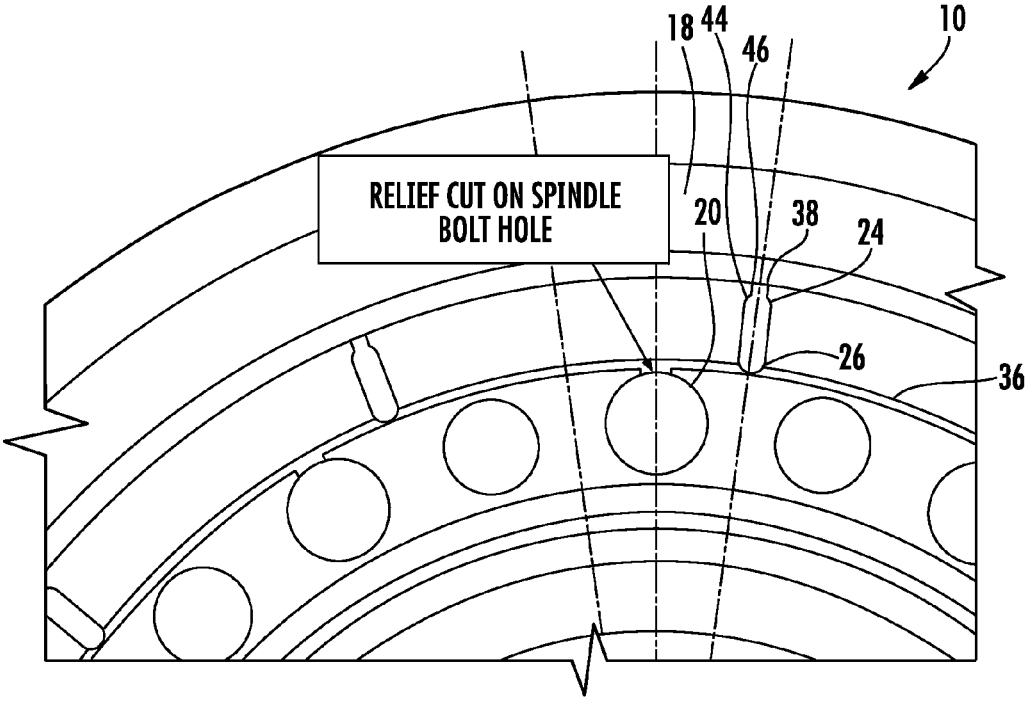
FIG. 12 is an end view of an alternative embodiment of the rotor disc of the rotor assembly with the spindle bolts removed and with offset relief channels that are also skewed to act as a nozzle.
Figure 13:
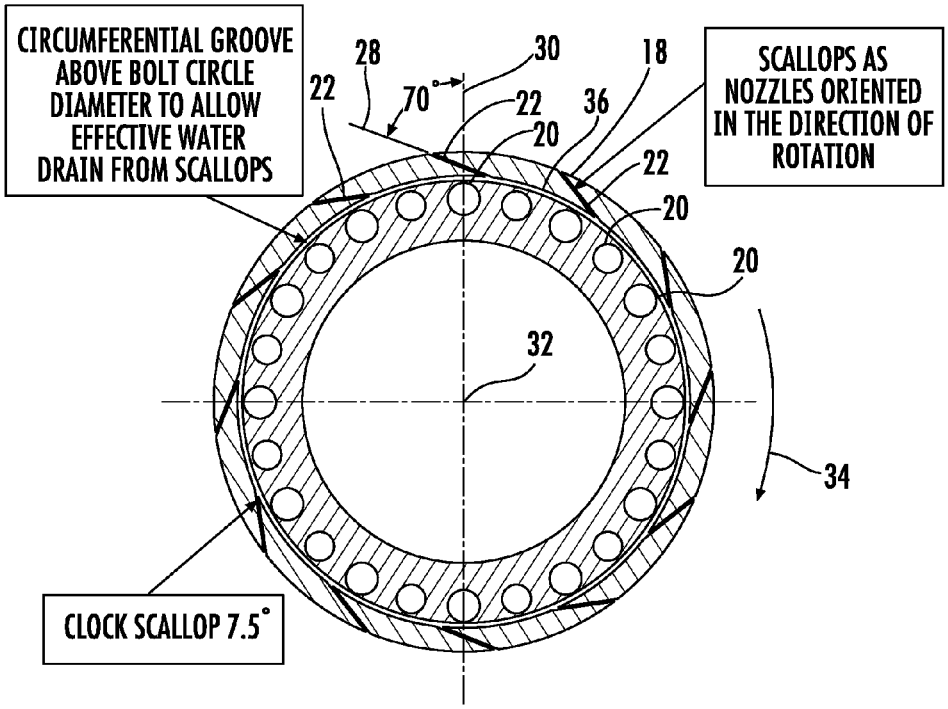
FIG. 13 is a bolt with scallops that does not show water stain marks.
Figure 14:
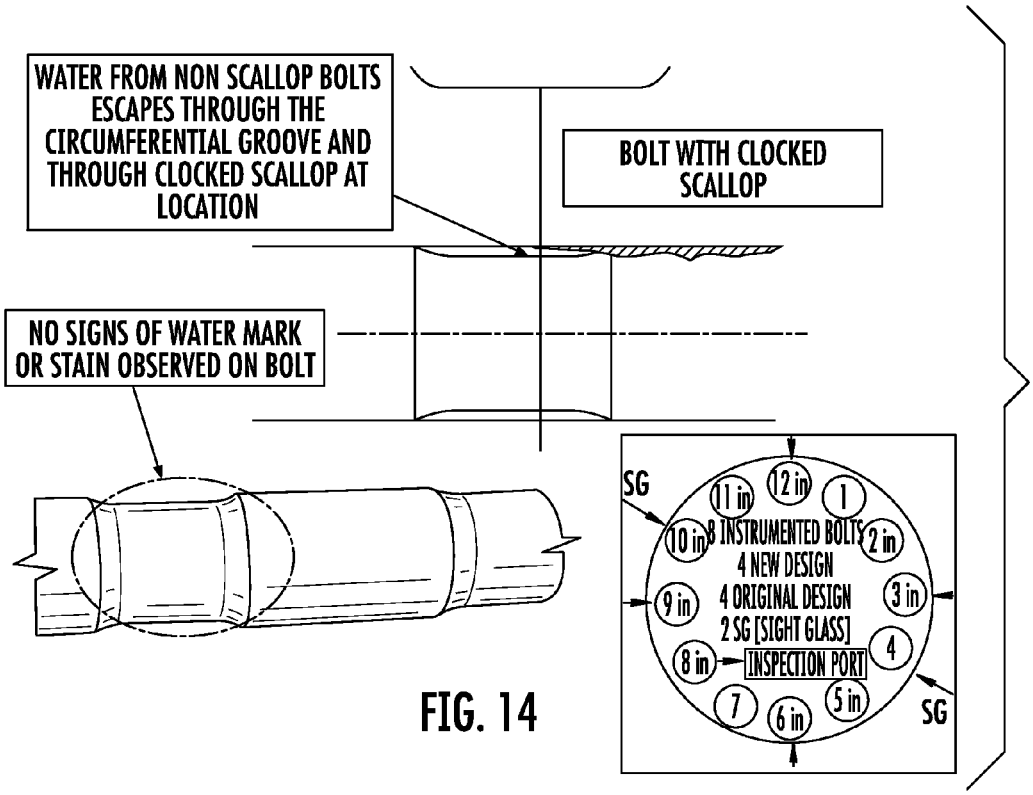
FIG. 14 is a partial cross-sectional view of a spindle bolt having water escape through circumferential grooves.

As shown in FIG. 12, a longitudinal axis 28 of the relief channel 22 may be nonlinear and nonorthogonal to a radially extending axis 30 extending from a centerpoint 32 of the rotor disc 10. The curved relief channel 22 may extend from the bolt hole 20 to the relief channel 22 and may allow water to escape from the bolt hole 20 into the relief channel 22. The curved relief channel 22 also eliminates direct blow back of air, water and debris particles on the spindle bolt 12. The inner opening 26 of the relief channel 22 may be advanced in a direction of rotation 34 of the rotor disc 10 relative to an outer opening 24. The longitudinal axis 28 of the relief channel 22 may be positioned between 55 degrees and 85 degrees relative to the radially extending axis 30 extending from the centerpoint 32 of the rotor disc 10. The longitudinal axis 28 of the relief channel 22 may be positioned at 70 degrees to the radially extending axis 30 extending from the centerpoint 32 of the rotor disc 10. The relief channel 42, as shown in FIG. 12, may also be machine curved to simulate a pump impeller and to increase the effectiveness of water removal.

The rotor disc 10 may include a circumferential groove 36 that places at least one of the spindle bolt holes 20 in fluid communication with at least one relief channel 22. The relief channel 22 may include a plurality of relief channels 22 spaced equidistant from each other around the rotor disc body 18. The rotor disc 10 may also have a boss 40 or a channel to prevent water from entering space between the spindle bolt 12 and the spindle bolt hole 20 in the first place, as shown in FIG. 1.

As shown in FIGS. 9-12, the relief channels 22 may include a nozzle 38 in fluid communication with an outer end 44 of the relief channel 22. The radially outer end 46 of the nozzle 38 may have a smaller cross-sectional area than the outer end 44 of the relief channel 22. As such, the nozzle 38 creates a negative pressure drop across the relief channel 22 that acts as a water pump to draw the condensation and debris more effectively without introducing any additional air flow.

Figure 3:
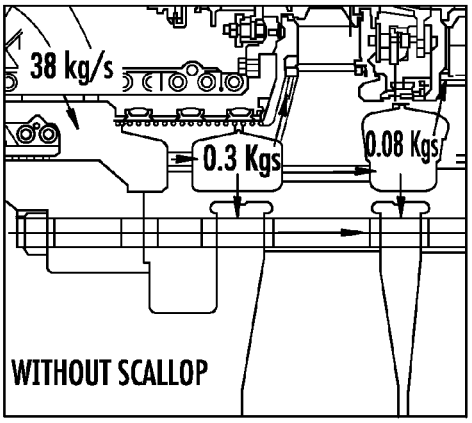
FIG. 3 is a partial cross-sectional view of the rotor assembly without relief channels.
Figure 4:
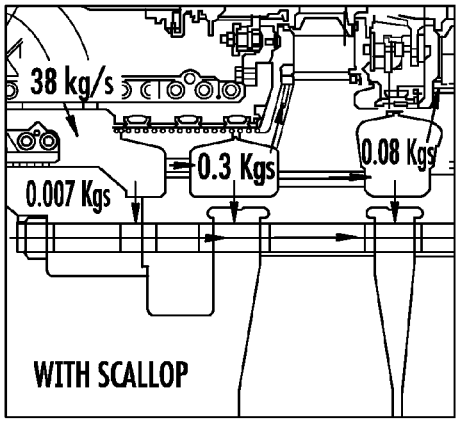
FIG. 4 is a partial cross-sectional view of the rotor assembly with relief channels enabling air to flow radially inward.
Figure 5:
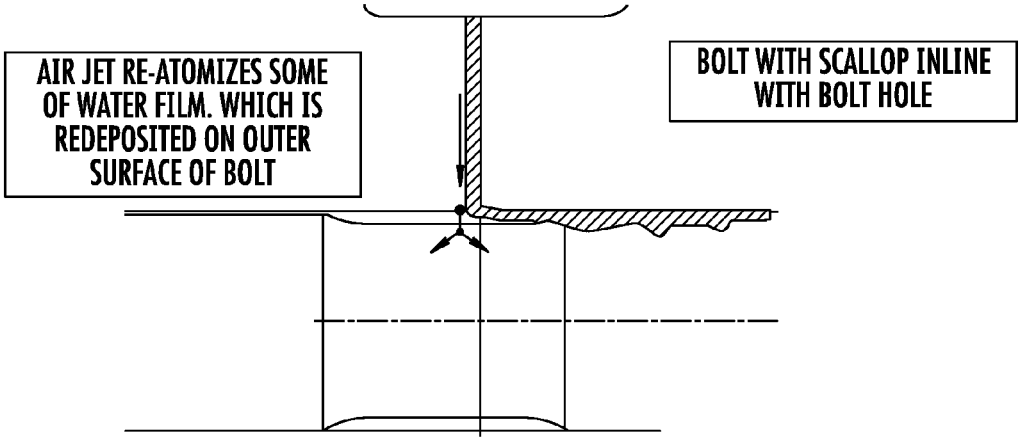
FIG. 5 is a partial cross-sectional view of a relief channel positioned proximate to a spindle bolt.
Figure 6:
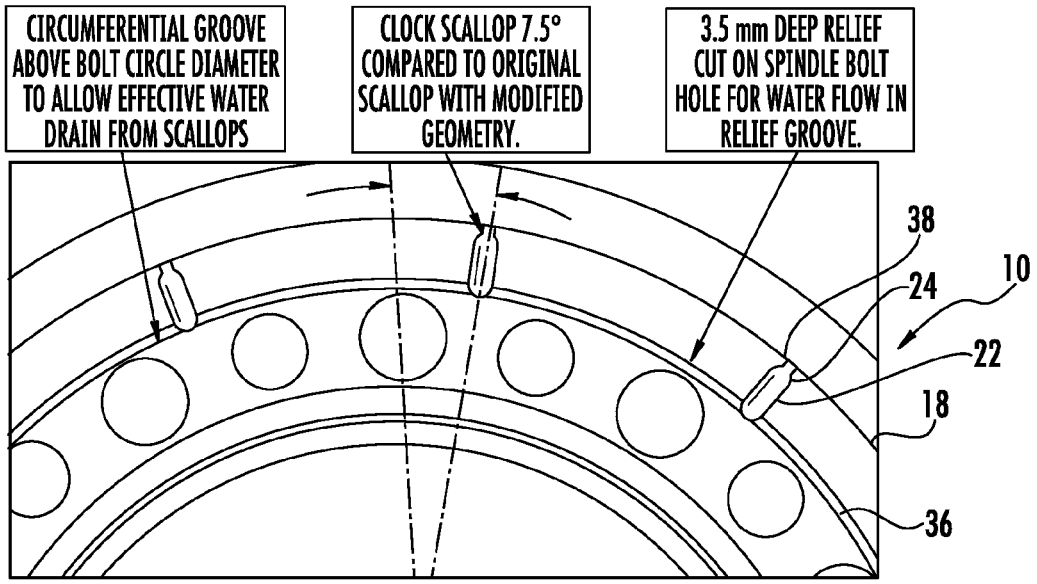
FIG. 6 is an end view of the rotor disc of the rotor assembly with the spindle bolts removed and with offset relief channels.
Figure 7:
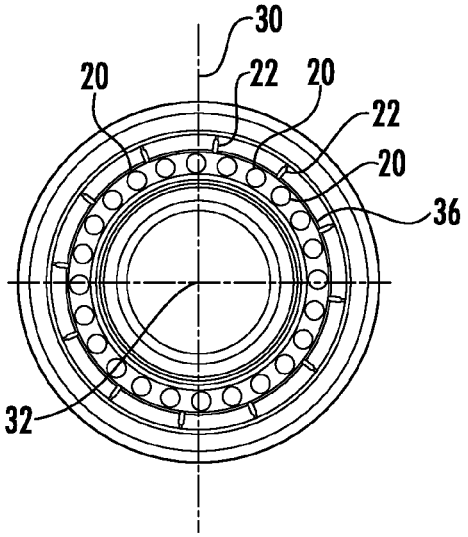
FIG. 7 is a detailed view of the rotor disc of the rotor assembly with the spindle bolts removed and with offset relief channels.
Figure 8:
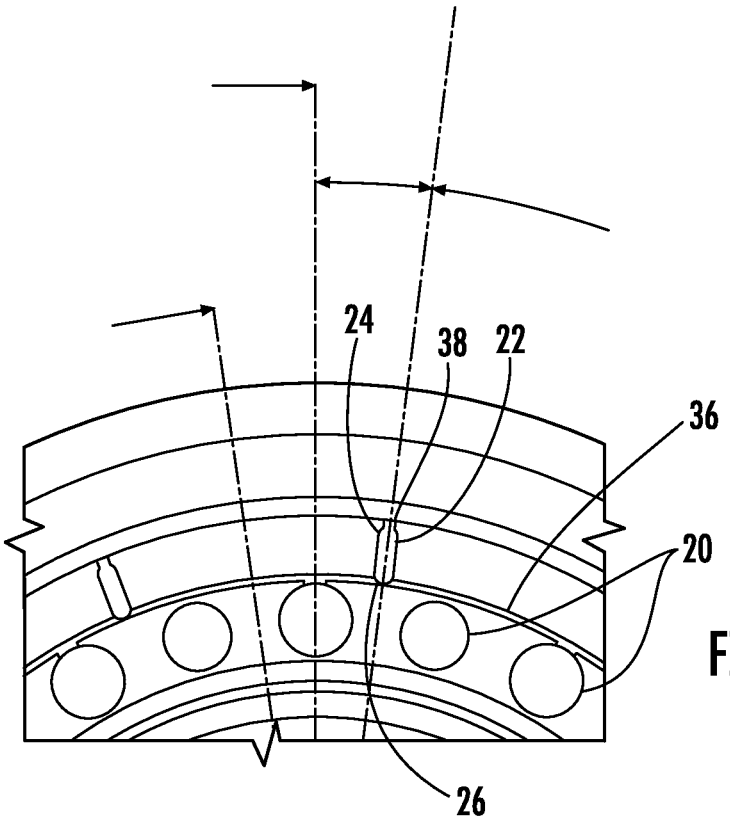
FIG. 8 is yet another detailed view the rotor disc of the rotor assembly with the spindle bolts removed and with offset relief channels.
Figure 9:
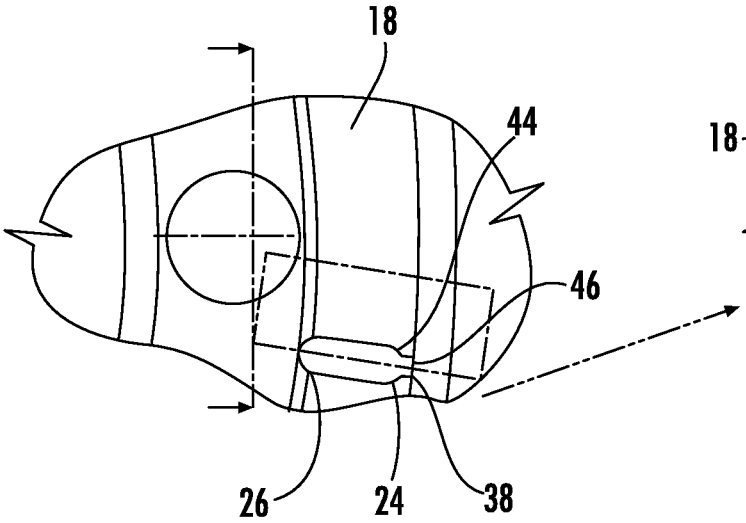
FIG. 9 is a detailed view of a portion of a relief channel and relief cuts.
Figure 10:
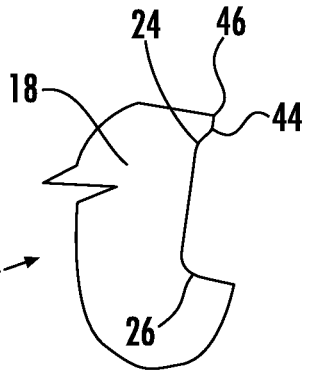
FIG. 10 is a detailed view of the rotor disc of the rotor assembly with the spindle bolts removed and with offset relief channels having nozzles.
Figure 11:
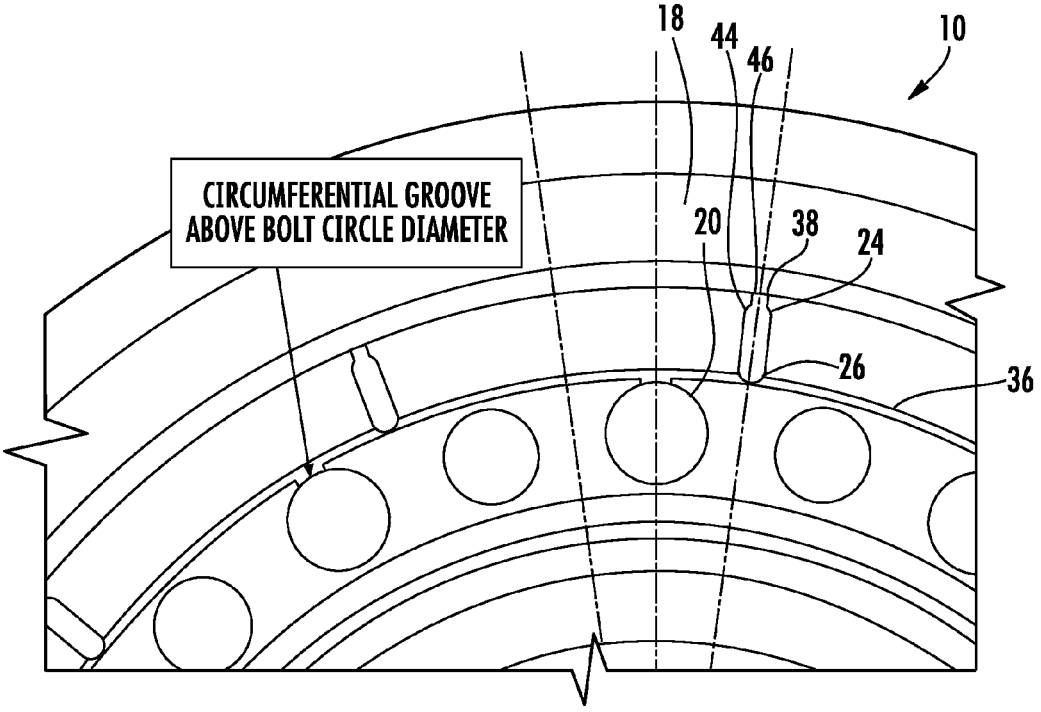
FIG. 11 is another detailed view of the rotor disc of the rotor assembly with the spindle bolts removed and with offset relief channels having nozzles.

During use, condensation forms in the space between the spindle bolt 12 and the surface forming the spindle bolt hole 20. Debris also collects in this space between the spindle bolt 12 and the surface forming the spindle bolt hole 20 as well. As the rotor discs spins, centrifugal forces cause the condensation to be forced outwardly into the circumferential groove 36, where the condensation and debris flow into the relief channels 22 and are exhausted out of the rotor disc body 18 through the outer opening 24. Forces created during operation are shown in FIGS. 3 and 4.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A system, comprising: a turbine engine having a rotor disc body having a plurality of circumferentially positioned spindle bolt holes sized to house a spindle bolt within each spindle bolt hole; and at least one relief channel extending radially outward of one of the spindle bolt holes, wherein a radially inner extent of the relief channel is radially outward of a radially outer extent of the bolt holes, wherein the at least one relief channel has a decreasing cross-sectional area moving radially outward.

2. The system of claim 1, wherein the at least one relief channel has a reduction in cross-sectional area of one half of its width across a length of the at least one relief channel.

3. The system of claim 2, wherein the at least one relief channel has an inner radius of 10 millimeters and an outer radius of 5 millimeters.

4. The system of claim 1, wherein the at least one relief channel is offset circumferentially from the spindle bolt hole.

5. The system of claim 4, wherein the at least one relief channel is offset circumferentially between five degrees and ten degrees from the spindle bolt hole.

6. The system of claim 4, wherein the at least one relief channel is offset circumferentially 7.5 degrees from the spindle bolt hole.

7. The system of claim 1, wherein a longitudinal axis of the at least one relief channel is nonlinear and nonorthogonal to a radially extending axis extending from a centerpoint of the rotor disc.

8. The system of claim 7, wherein an inner opening of the at least one relief channel is advanced in a direction of rotation of the rotor disc from an outer opening.

9. The system of claim 7, wherein the longitudinal axis of the at least one relief channel is positioned between 55 degrees and 85 degrees relative to the radially extending axis extending from the centerpoint of the rotor disc.

10. The system of claim 7, wherein the longitudinal axis of the at least one relief channel is positioned at 70 degrees to the radially extending axis extending from the centerpoint of the rotor disc.

11. The system of claim 1, further comprising a circumferential groove that places at least one of the spindle bolt holes in fluid communication with the at least one relief channel.

12. The system of claim 1, wherein the at least one relief channel comprises a plurality of relief channels spaced equidistant from each other around the rotor disc body.

13. The system of claim 1, further comprising a nozzle in fluid communication an outer end of the relief channel, wherein a radially outer end of the nozzle has a smaller cross-sectional area than the outer end of the relief channel.

14. The system of claim 1, wherein the at least one relief channel has a curved longitudinal axis.

15. The system of claim 1, further comprising a boss coupled to a seal disc face adjacent to the spindle bolt holes to prevent the ingress of condensation into the spindle bolt holes.

16. A rotor disc of a turbine engine, comprising:

a rotor disc body having a plurality of circumferentially positioned spindle bolt holes sized to house a spindle bolt within each spindle bolt hole;

at least one relief channel extending radially outward of one of the spindle bolt holes, wherein a radially inner extent of the relief channel is radially outward of a radially outer extent of the bolt holes, wherein the at least one relief channel has a decreasing cross-sectional area moving radially outward;

a circumferential groove that places at least one of the spindle bolt holes in fluid communication with the at least one relief channel;

a nozzle in fluid communication an outer end of the relief channel, wherein a radially outer end of the nozzle has a smaller cross-sectional area than the outer end of the relief channel.

17. The rotor disc of claim 16, wherein the at least one relief channel has a reduction in cross-sectional area of one half of its width across a length of the at least one relief channel.

18. The rotor disc of claim 16, wherein the at least one relief channel is offset circumferentially from the spindle bolt hole between five degrees and ten degrees from the spindle bolt hole.

19. The rotor disc of claim 16, wherein a longitudinal axis of the at least one relief channel is nonlinear and nonorthogonal to a radially extending axis extending from a centerpoint of the rotor disc.

20. The rotor disc of claim 19, wherein an inner opening of the at least one relief channel is advanced in a direction of rotation of the rotor disc from an outer opening.

* * * * *